US007220317B2

(12) United States Patent
Smythe

(10) Patent No.: US 7,220,317 B2
(45) Date of Patent: May 22, 2007

(54) DRYWALL MUD HOPPER FOR INSIDE AND OUTSIDE CORNERS

(76) Inventor: Timothy D. Smythe, 4017 Northcliff, Bend, OR (US) 97701

( * ) Notice: Subject to any disclaimer, the term of this patent is extended or adjusted under 35 U.S.C. 154(b) by 397 days.

(21) Appl. No.: 10/745,958

(22) Filed: Dec. 27, 2003

(65) Prior Publication Data

US 2004/0187435 A1 Sep. 30, 2004

Related U.S. Application Data

(60) Provisional application No. 60/436,998, filed on Dec. 28, 2002.

(51) Int. Cl.
*B05C 3/00* (2006.01)

(52) U.S. Cl. ..... 118/404; 118/405; 118/413

(58) Field of Classification Search ..... 118/404, 118/405, 413, DIG. 2; 141/67, 98; 425/87, 425/375; 401/5, 9, 193, 266; 15/105.5, 15/235.3, 235.6, 235.7
See application file for complete search history.

(56) References Cited

U.S. PATENT DOCUMENTS 3,087,654 A * 4/1963 Moore ..... 401/9
3,209,389 A * 10/1965 Stahl ..... 425/87
5,695,788 A * 12/1997 Woods ..... 425/87

OTHER PUBLICATIONS

Pla-Cor Inc.—Convertible Hopper Advertisement, Jun. 1995.*

* cited by examiner

*Primary Examiner*—George Koch
(74) *Attorney, Agent, or Firm*—Clifford Kraft

(57) ABSTRACT

A drywall hopper assembly that contains a double blade that can apply drywall mud to both interior and exterior drywall corners with no blade change. A zig-zag blade can contain two parallel grooves, one for interior corners and one for exterior corners. With this blade arrangement, an operator can quickly move from one type of corner to another without using multiple tools, multiple blades or hand application methods to apply mud. The present invention can contain a pliable release port to present mud equally to an interior or an exterior corner. There can be such a port on both the top and bottom of the blade so that mud is smoothly applied as the operator moves the tool along the seam.

13 Claims, 6 Drawing Sheets

DRYWALL MUD HOPPER FOR INSIDE AND OUTSIDE CORNERS

This application is related to and claims priority from U.S. Provisional Patent Application 60/436,998 filed Dec. 28, 2002 and hereby incorporates that application by reference.

BACKGROUND

1. Field of the Invention

The present invention relates to the field of drywall installation and more particularly to a drywall mud hopper that allows application of mud to both interior and exterior drywall corners.

2. Description of the Prior Art

Prior art hoppers only allow finishing of exterior drywall corners. This is because prior art hoppers only contain an exterior blade. Some hoppers allow changing of the blade; however, no prior art hopper contains a double blade that will allow the operator to finish both interior and exterior corners with the convenience of not having to change blades. Applying mud to inside corners without a hopper is a slow and tedious process. What is needed is a drywall mud hopper that will allow finishing of both interior and exterior corners with no blade or tool change or setup.

SUMMARY OF THE INVENTION

The present invention relates to a drywall hopper assembly that contains a double zig-zag or other blade that can apply drywall mud to both interior and exterior drywall corners with no blade change.

The zig-zag blade of the present invention can contain two parallel grooves, one for interior corners and one for exterior corners. With this blade arrangement, an operator can quickly move from one type of corner to another without using multiple tools, multiple blades or hand application methods to apply mud.

The present invention can contain a pliable polymer release port to present mud equally to an interior or an exterior corner. There can be such a port on both the top and bottom of the blade so that mud is smoothly applied as the operator moves the tool along the seam.

Several illustrations have been presented to better explain the present invention. The scope of the present invention is not limited to the embodiments shown in the figures.

DETAILED DESCRIPTION

Figure 1:
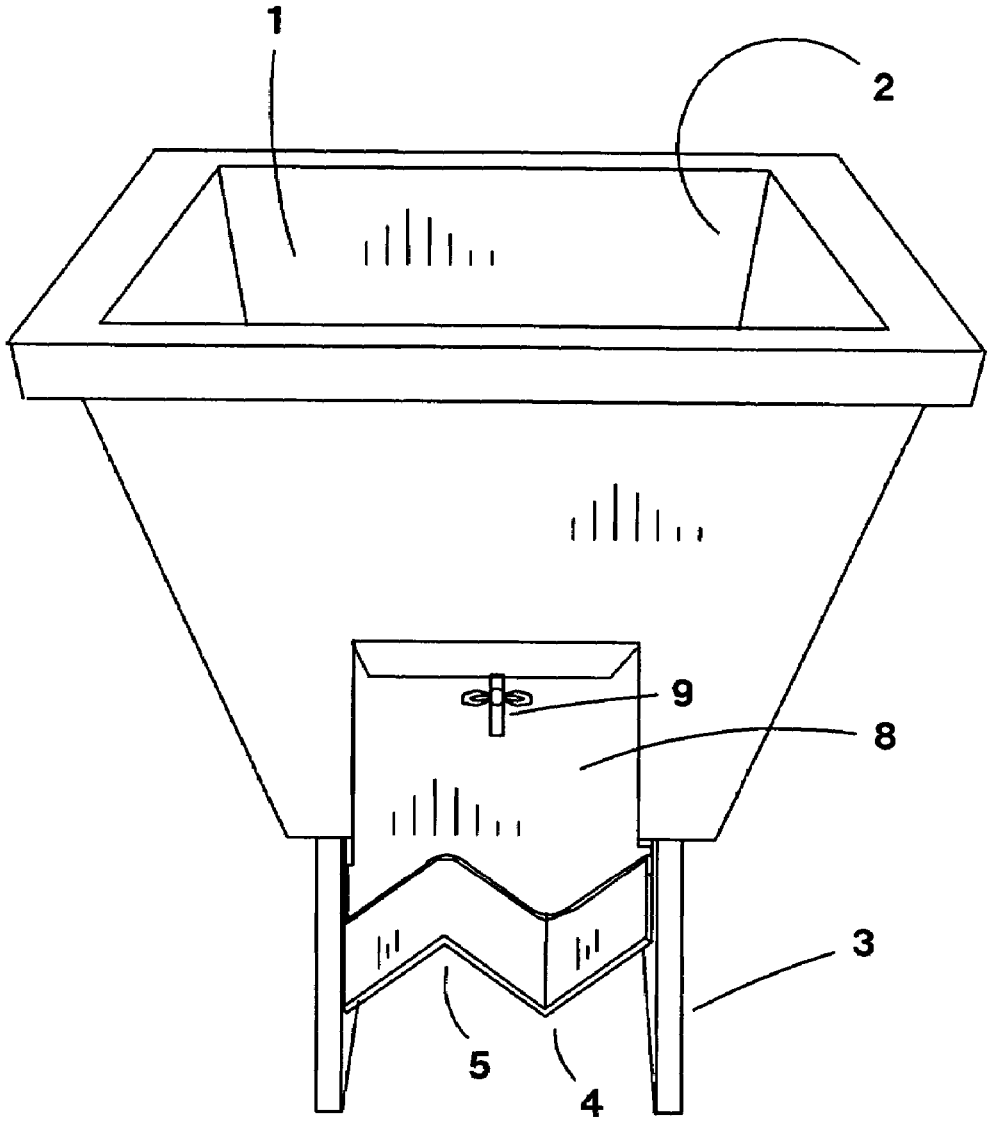
FIG. 1 shows a side perspective view of an embodiment of the present invention.
Figure 2:
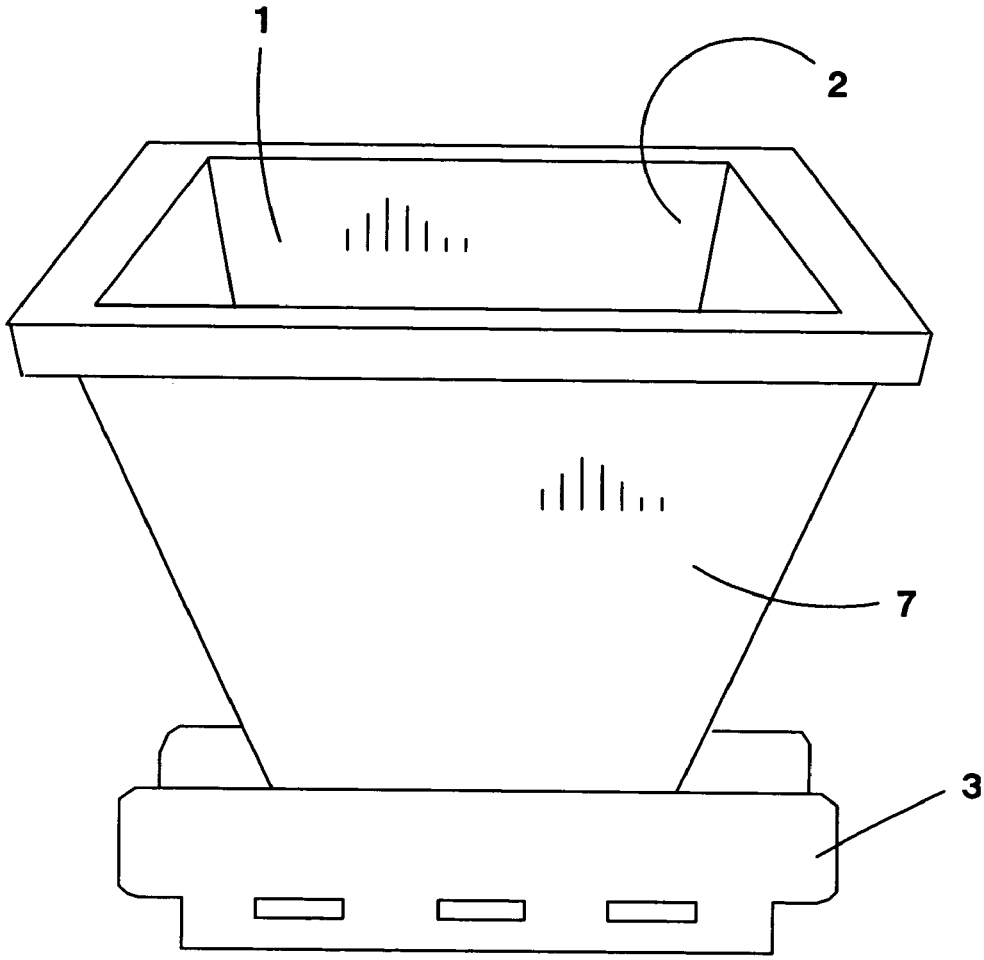
FIG. 2 shows the same view as FIG. 1 with the hopper rotated ninety degrees.

FIGS. 1–2 show general perspective views of the present invention. A hopper 1 with slanted sidewalls 2 narrows into a metal blade 3 at its base. The blade 3 can contain two parallel sub-blades in the form of a zig-zag, one for exterior corners 5 and one for interior corners 4. Above the blade can be a control plate 8 that can be secured to the blade body 3 with a protruding screw and wingnut. The unique shape of the zig-zag blade 3 allows instant application of mud to both interior and exterior corners with no blade change and no manual application necessary. The hopper 1 can be made of any durable material with plastic being preferred. The blade can be any hard, very rigid material with steel or aluminum being preferred.

Figure 3:
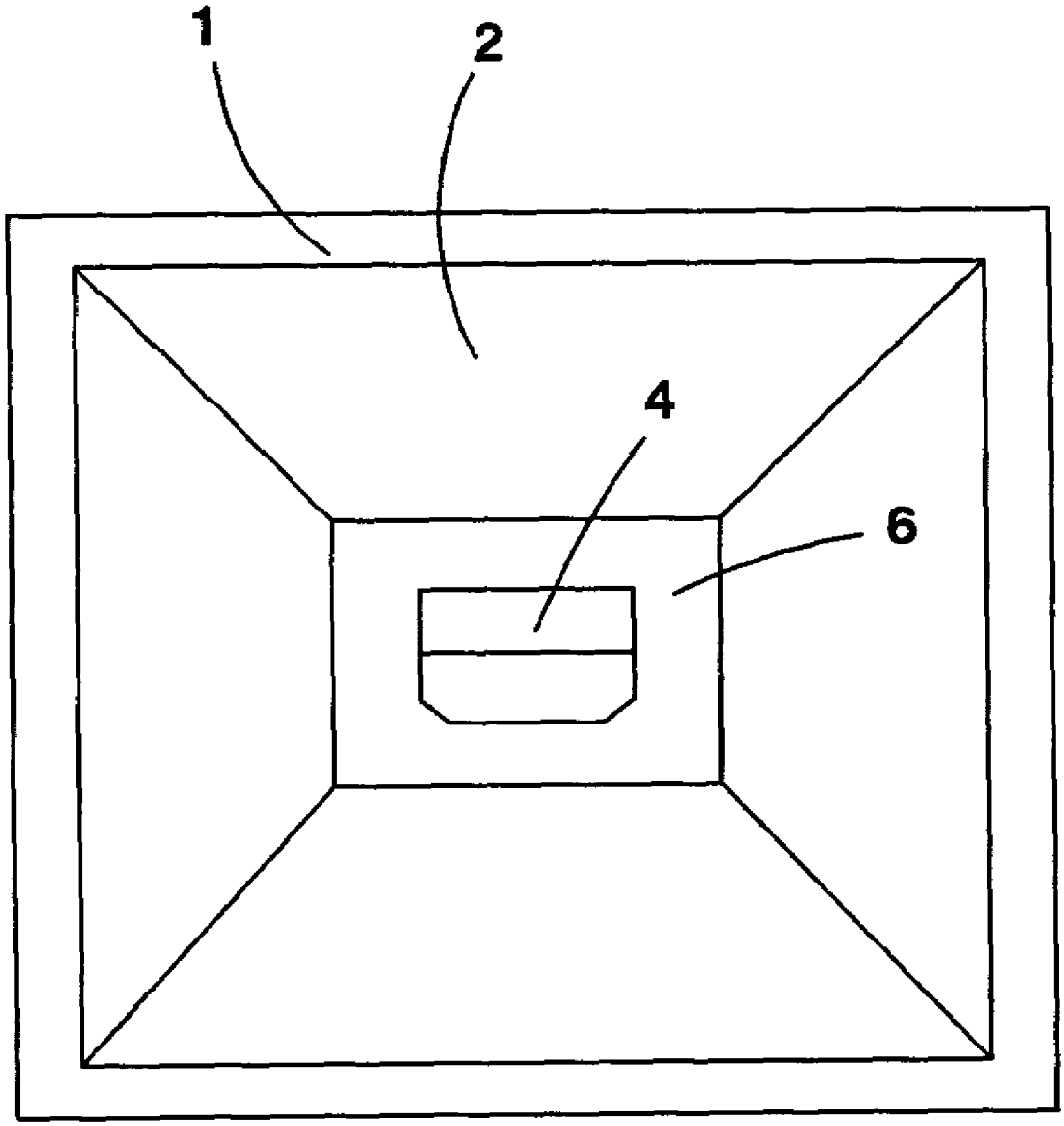
FIG. 3 shows a view looking into the top of the hopper.

FIG. 3 is a top view looking into the hopper 1. The slanted sidewall 2 is visible along with a mud outlet opening 6 in the bottom of the hopper 1. The mud opening 6 dumps mud onto the blade top surface 4.

Figure 4A:
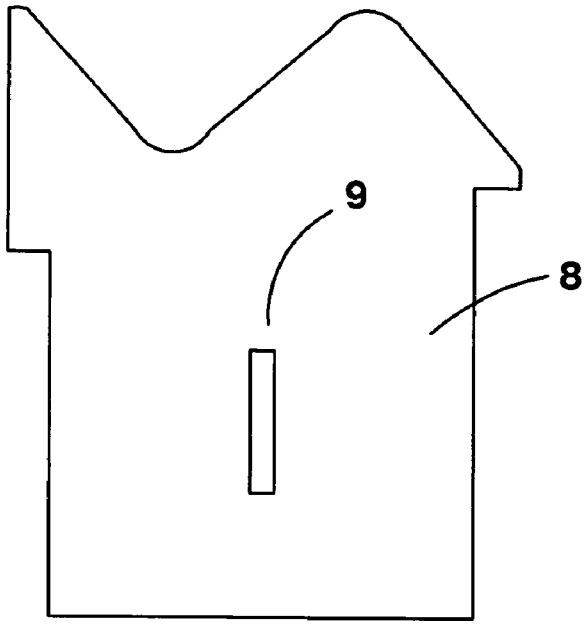
FIGS. 4A and 4B show details of an embodiment of a dispensing port with two parts.
Figure 4B:
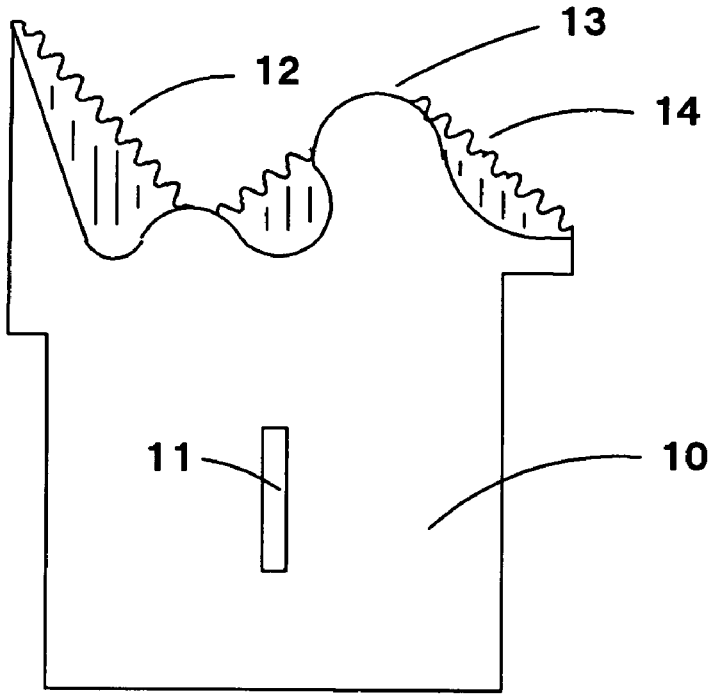

FIGS. 4A–4B show details of the blade assembly 3. The hopper 1 has a slanting outside surface 7 (FIG. 2) that can be secured to the blade assembly 3 so that the hopper 1 dumps drywall mud into it. The blade assembly 3 contains a double blade with a section grooved for exterior corners 5 and a section grooved for interior corners 4. A control plate 8 is secured onto each end of the blade with a stub screw and can be adjusted to control the release of mud. This adjustment of the end plate 8 along the stub screw determines the exact quantity of mud dispensed. FIG. 4B in particular, shows a dispensing port 10 that can be mounted behind the control plate 8 at each end of the blade 3. The dispensing port 10 is specially shaped with teeth to control the outflow of mud. It can be seen that the end port 10 has the general shape of the blade grooves 4, 5 and has teeth 12, 14 to allow and control the outflow of mud. The end port can be shaped various ways with optional protrusions 13 to reenforce the teeth.

Figure 5A:
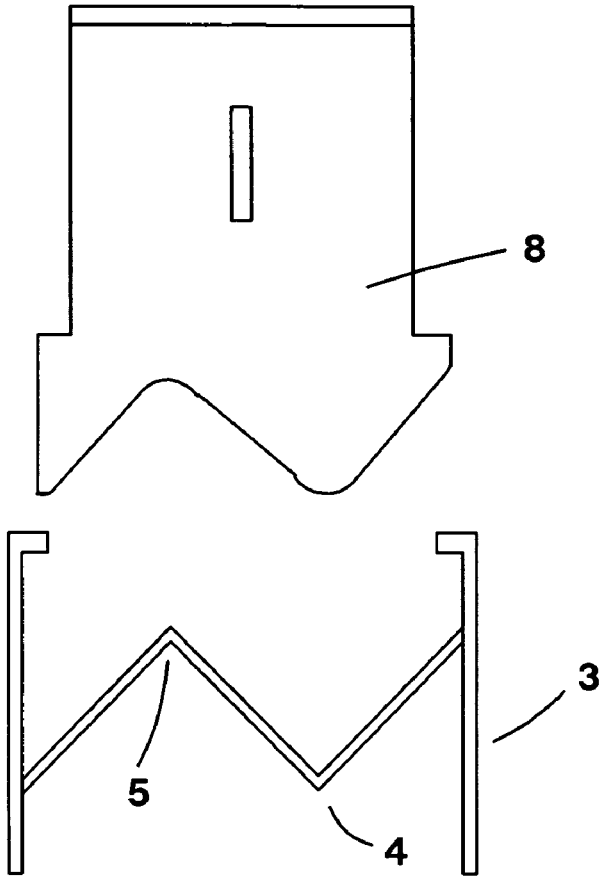
FIGS. 5A and 5B show how the dispensing port meshes with the corner matching piece.
Figure 5B:
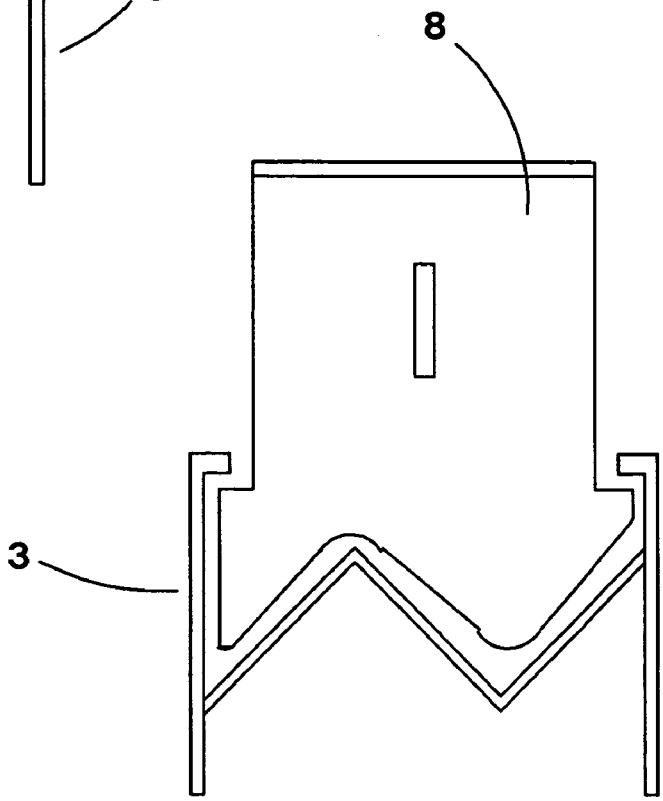

FIGS. 5A and 5B show how the end plate 8 meshes with the blade 3. Both the control plate 8 and the dispensing port 10 can contain a slot 9, 11 that follows the stub screw and allows for adjustment of the control plate 8 and dispensing port 10. The end plate can be any rigid material with steel or aluminum being preferred. The teeth 13, 15 that are attached to the dispensing port 10 can be clearly seen. These teeth allow mud to pass out as well as controlling the amount of mud. It can be seen the dispensing port 10 also follows the general shape of the blade 3 from previous figures. The dispensing port 10 is equipped with a similar slot 11 that matches the slot 9 in the control plate 8. Both the dispensing plate and the control plate can be made of metal such as steel or aluminum or the dispensing plate can be made of plastic or a fibrous material, or the teeth can be made of a fibrous material. It should be generally noted that better performance is obtained if the dispensing plate is flexible. It can be made from flexible plastic, rubber or other material that bends or flexes easily. Thus the dispensing port 10 can be made out of any durable, flexible material with a polymer being preferred. Various soft plastics work well. The dispensing port 10 generally is able to bend slightly to dispense mud properly; however this bending action is optional.

Figure 6:
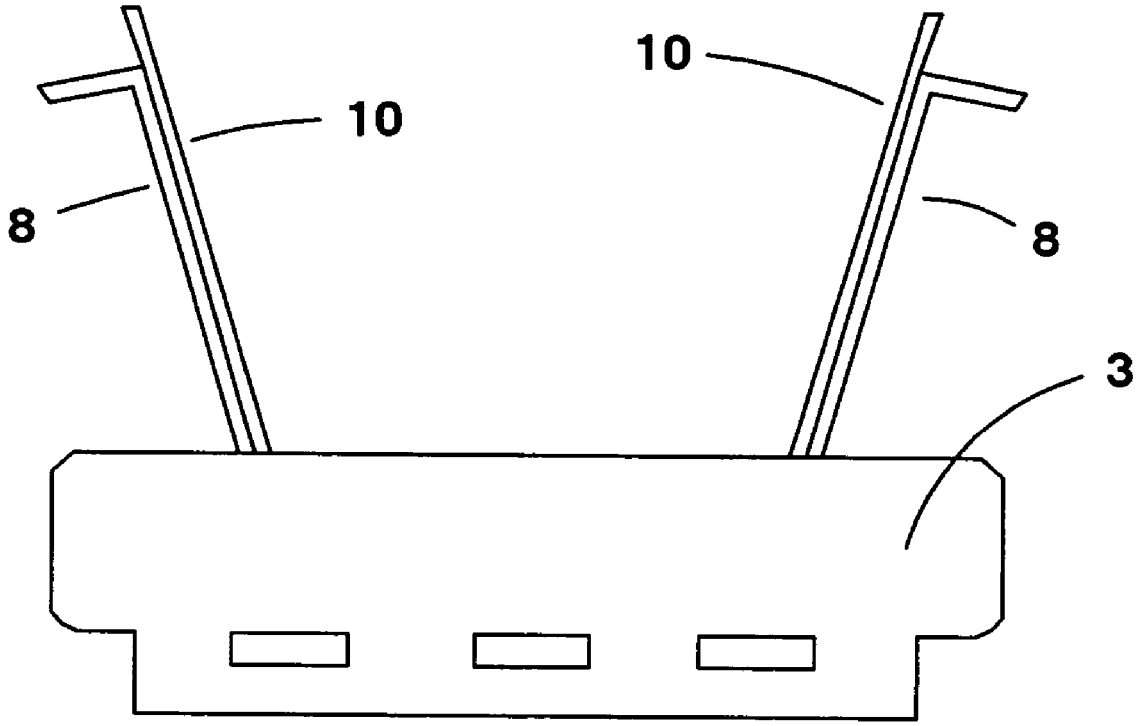
FIG. 6 shows the view of FIG. 5A turned 90 degrees.

FIG. 6 shows a side view of the blade 3, the control port 8 and the dispensing port 10 at each end of the blade. The assembly shown in FIG. 6 fits on the bottom of the hopper body 1 with the outside hopper wall 7 generally mating with the blade 3.

It should be noted that alternate removable blades are possible and are within the scope of the present invention. These optional removable blades could replace the blade 3 shown in the figures and be configured for different types of corners or joints.

Several descriptions and illustrations have been used to explain the present invention. One of skill in the art would realize that many changes and variations are possible. These changes and variations are within the scope of the present invention.

I claim:

1. A mud dispensing hopper comprising:

a hopper body for holding a reservoir of wet mud;

a mud outlet opening in said hopper wherein wet mud can pass through said opening;

a zig-zag blade attached to said hopper body in proximity to said mud outlet opening, wherein said zig-zag blade contains a convex part and a concave part, and wherein said convex part applies mud for interior corners and said concave part applies mud for exterior corners;

at least one control plate in proximity to said mud outlet opening and said zig-zag blade, said control plate controlling flow of said mud.

2. The mud dispensing hopper of claim 1 further comprising a dispensing port mounted in proximity to said control plate.

3. The mud dispensing hopper of claim 2 wherein said dispensing port has teeth to control mud flow.

4. The mud dispensing hopper of claim 2 wherein said dispensing port is plastic.

5. The mud dispensing hopper of claim 2 wherein said dispensing port contains a plurality of teeth.

6. The mud dispensing hopper of claim 1 wherein said control plate is metal.

7. The mud dispensing hopper of claim 1 wherein said control plate is plastic.

8. The mud dispensing hopper of claim 1 wherein said zig-zag blade is removable.

9. A mud hopper for use in drywall finishing work where mud is used to finish both interior and exterior drywall corners, the mud hopper being filed with wet mud from the top and dispensing the wet mud from the bottom through a mud dispensing hole, the mud hopper comprising a zig-zag blade mounted in proximity to the bottom of the mud hopper so that wet mud flows out of the hopper and along the blade and onto a drywall corner, flow of wet mud being controlled by at least one control plate mounted in proximity to the zig-zag blade in a position to control rate of flow of the mud, the control plate being adjustable to allow different mud flow rates, the control plate being shaped to approximately match the contour of the zig-zag blade, and wherein said zig-zag blade contains a convex part and a concave part, wherein said convex part applies mud for interior corners and said concave part applies mud for exterior corners.

10. The mud hopper of claim 9 further comprising a dispensing port behind the control plate to better control the dispensing of the mud.

11. The mud hopper of claim 10 wherein the dispensing port is made of plastic.

12. The mud hopper of claim 10 wherein said dispensing port contains a plurality of teeth.

13. The mud hopper of claim 9 wherein the control plate and zig-zag blade are made of metal.

* * * * *